US006024650A

United States Patent [19]

Reeves

[11] Patent Number: 6,024,650

[45] Date of Patent: Feb. 15, 2000

[54] IMPRINTABLE GOLF CLUB HEAD

[76] Inventor: John Reeves, 11349 167th St., Orland Park, Ill. 60462

[21] Appl. No.: 09/015,185

[22] Filed: Jan. 29, 1998

[51] Int. Cl.[7] ..... A63B 53/04

[52] U.S. Cl. ..... 473/287; 473/313; 473/324; 473/340

[58] Field of Search ..... 473/330, 331, 473/325, 324, 409, 340, 341, 313, 251, 252, 253, 254, 255, 290, 287; D21/735, 736, 738

[56] References Cited

U.S. PATENT DOCUMENTS

| | | |
|---|---|---|
| D. 202,114 | 8/1965 | Mader . |
| D. 205,953 | 10/1966 | Mader . |
| D. 209,524 | 12/1967 | Mader . |
| D. 307,309 | 4/1990 | Doran . |
| 1,319,802 | 10/1919 | Shea . |
| 1,603,850 | 10/1926 | Keating . |
| 2,998,254 | 8/1961 | Rains . |
| 3,564,735 | 2/1971 | Fisher . |
| 3,749,408 | 7/1973 | Mills . |
| 3,884,477 | 5/1975 | Bianco . |
| 4,508,342 | 4/1985 | Drake . |
| 5,244,210 | 9/1993 | Au . |
| 5,340,107 | 8/1994 | Baker . |
| 5,692,969 | 12/1997 | Schooler . |

*Primary Examiner*—Sebastiano Passaniti
*Attorney, Agent, or Firm*—Hill & Simpson

[57] ABSTRACT

A golf club putter head is provided in the shape of a quarter cylinder with a quarter cylinder outer surface having an imprintable material thereon. Four such golf club putter heads may be assembled and inserted into a cylindrical imprinting apparatus, such as an imprinter for coffee mugs for imprinting custom images and designs on the outer cylindrical portion of the putter heads.

7 Claims, 2 Drawing Sheets

38
18
26
36
38
16
24
20
20
38
36
38
28
34
24
30
18
36
32
34
12
14
10
18
22
16
20
14
15
17
16
18
19
13
26
24
20

IMPRINTABLE GOLF CLUB HEAD

BACKGROUND OF THE INVENTION

1. Field of the Invention

The present invention relates generally to a golf club head and, in particular, to a head of a golf putter having an imprintable surface.

2. Description of the Related Art

Golf club heads and, in particular, putters are made of a variety of materials and in a variety of shapes.

Imprinting of coffee cups and coffee mugs has become common place wherein a logo or design or even a personal photograph is imprinted on the exterior cylindrical surface of the coffee mug. Commercial devices are available for imprinting an image on a mug in a store or shop setting using an image generated by a standard computer printer.

SUMMARY OF THE INVENTION

An object of the present invention is to provide a golf club, in particular a putter, having an imprinted design or logo or other image appearing thereon.

Another object of the present invention is to provide a golf putter which can be imprinted inexpensively and easily with little equipment outlay.

Yet another object of the present invention is to provide a golf putter having an imprint indicative of an event such as a golf outing or tournament, a place such as a golf course, or of a player.

These and other objects and advantages of the present invention are provided by a golf putter head having the shape of a quarter cylinder and having at least an outer surface of a material capable of accepting an imprint. The quarter cylinder-shaped putter head provides a first generally planer surface for contact with the ball during putting, a second planer surface generally at a right angle to the first planer surface which rides over the ground during putting, and a cylindrical portion outer surface forming a quarter of a cylinder. The cylindrical portion outer surface is of a polyester coating in a preferred embodiment. The axial ends of the quarter cylinder are curved for a pleasing aesthetic appearance.

Four of the quarter cylinder putter heads are assembled to form a cylinder which is approximately of a diameter of a drinking mug, such as a coffee mug. The outer surface of the cylinder is made up of the imprintable surface of the four putters. When the four putter heads are assembled, they are positionable in a mug imprinting apparatus so that the outer cylindrical surface portions of the putters may be imprinted with a design or image by the mug imprinting apparatus. After printing, the putter heads are removed, separated from one another and a club shaft and grip installed on each.

While it is preferred to imprint four putter heads at the same time, it is also contemplated to provide a dummy head which may be of a quarter cylinder shape, a half cylinder shape, or three quarters cylinder shape which is positioned with the requisite number of putters to complete the cylinder in the mug printer.

In a first embodiment, the putter head is of a white ceramic material which is generally the same material of which coffee mugs are formed although many other materials may be used as well. The external cylindrical surface of the putter, and possibly all surfaces of the putter, are coated with a polymer or porous coating. The coating receives the imprintable image from the imprinting apparatus such as by die sublimation or wax transfer. It is contemplated to provide optional inserts or hollows in the putter head to a effect the change in the weight and/or center of gravity of the putter head for varying performance characteristics during use of the putter head in putting a golf ball. It is further contemplated to provide the entire putter head of a material, such as brass, which has an outer cylindrical surface of a material adapted to receive the imprinted image. For example, a ceramic or polymer coating may be provided on the cylindrical outer surface of a brass putter head.

Using the present invention, an individual may have a personalized golf putter prepared with the player's name or photograph. A golf course or country club may have putters prepared with the course name and/or logo or special putter heads may be prepared for specific events such as tournaments, outings or other events. All this may be accomplished using inexpensive, readily available and easy to operate mug imprinting equipment.

DETAILED DESCRIPTION OF THE PREFERRED EMBODIMENTS

Figures 1, 2, 3:
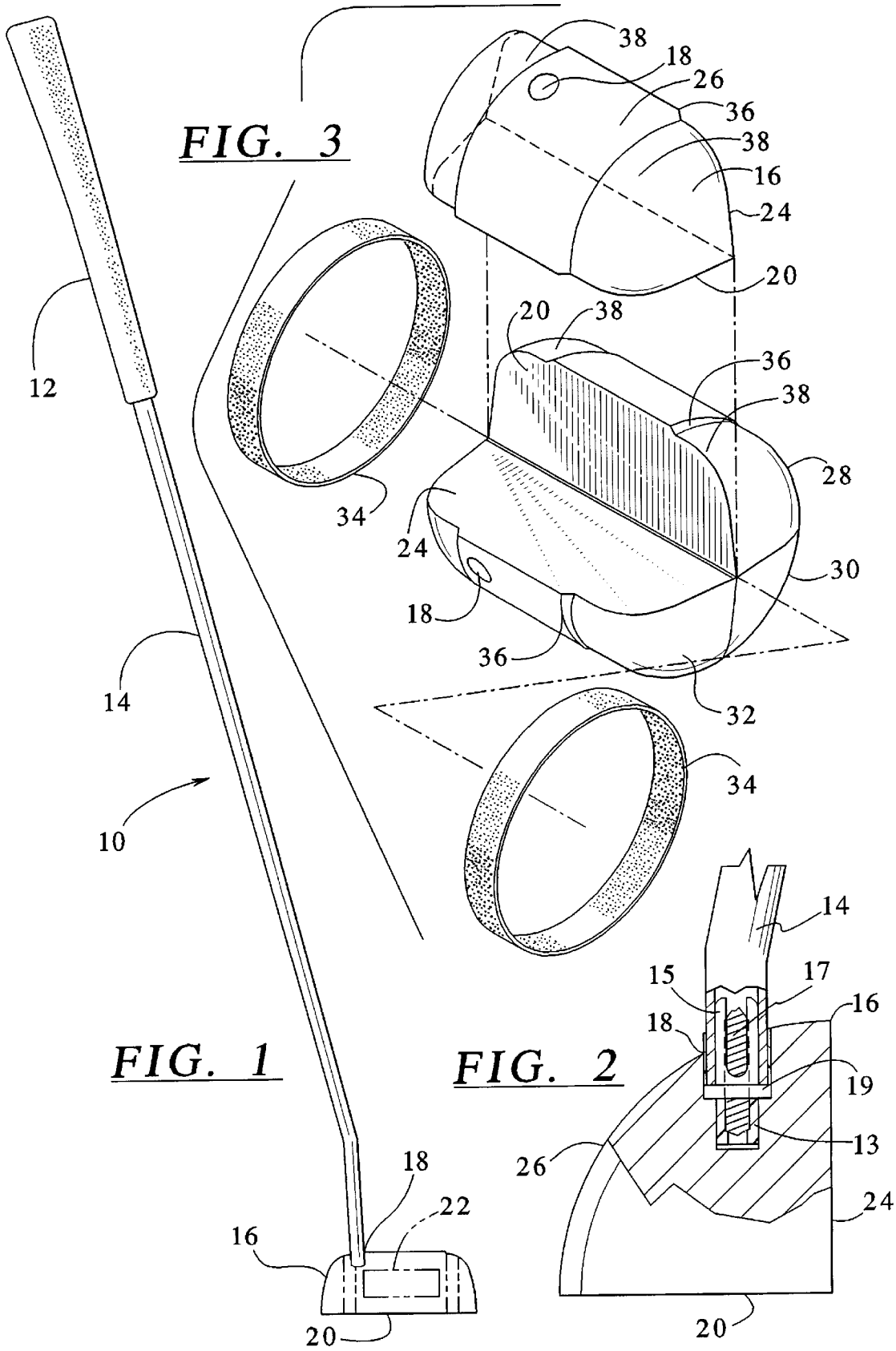
FIG. 1 is an elevational view of a golf putter including the putter head of the present invention.
FIG. 2 is an end elevational view, enlarged relative to FIG. 1, showing the putter head of the present invention and a fragmentary view of a portion of the club shaft.
FIG. 3 is an exploded view of the putter head of the present invention being positioned with three other putter heads of the invention and retaining bands.

Referring first to FIG. 1, a golf putter club 10 is shown including a grip 12, a club shaft 14 and a club head 16. The club head 16 is mounted to the end of the club shaft 14 at a shaft mounting opening 18. A flat surface 20 is provided on the lower side of the club head 16 as the club sole for travel above the ground. Imprints 22 are shown on the putter head 16. The imprints 22 are decorative designs, logos, or photographs.

In FIG. 2, the putter head 16 is mounted on the club shaft 14 at the opening 18 by the end of the club shaft 14 extending into the opening 18 and being affixed there by a fastener assembly. The fastener includes a threaded grommet 13 which is glued into the opening 18 by an adhesive. An expansion fitting 15 is inserted into the end of the club shaft 14 and a threaded screw 17 is screwed in part way. The head of the screw 17 is cut off, a spacer ring 19 is positioned at the end of the club shaft 14 and the screw 17 is screwed into the grommet 13 in the putter head 16. An adhesive is preferably used to fix the fastener assembly in place. The club head 16 itself has the flat bottom surface or sole 20, a ball striking surface 24 and an imprintable surface 26 defining a portion of a cylinder. In the illustrated embodiment, the lower flat surface 20 and the ball striking surface 24 are at a right angle to one another. Other angles are contemplated, for example to add a slight loft to the ball striking face 24 of the putter. In addition, the planer lower surface or sole 20 may be curved somewhat in a direction parallel to the cylinder axis and/or in a perpendicular to the cylinder axis to provide ground clearance during the putting stroke.

In FIG. 3, the putter head 16 is shown as a blank with three additional blank putter heads 28, 30 and 32. By positioning the four quarter-cylinder-shaped putter heads with their generally planar faces adjacent to one another, the four putter heads form a cylinder. Two retaining bands 34 are provided according to invention to hold the four putter heads together in the shape of the cylinder. The retaining bands 34 of a preferred embodiment are rubber bands which elastically secure the putter heads 16, 28, 30 and 32 in position. As an alternative, a rigid tubular or form-fitting end cap which includes an end face to fit against the end of the cylinder and a ring which is shaped to engage the outer cylindrical portion surfaces of the putter heads may be provided to hold the putter heads together and standing vertical for graphic application production line processing in automated mug machines. Thus emulating the properties of a single canor mug standing straight-up or on its side in order to roll.

Although it is possible to provide the four putter heads 16, 28, 30 and 32 bearing directly against one another in forming the cylindrical shape, it is also contemplated to provide an adhesive between the adjoined putter heads. The adhesive prevents shifting and movement of the putter heads relative to one another during the imprinting process. In a putter head having a curved surface such as the lower surface 20 or an angled surface such as a slightly lofted ball striking surface 24, the adhesive may accommodate the curve or angle so that the assembled four putter heads forms the cylindrical body.

In the illustrated embodiment, the imprintable surface 26 is raised above the outer profile of the cylinder at a ridge 36. Said another way, the ends 38 of the cylindrical surface are of a smaller radius than the ridge 36. The retaining bands 34 are positioned in the smaller radius portions 38 so that they are out of the way during imprinting.

All or some of the further putter blanks 28, 30 or 32 may be dummy blanks to support one, two or three actual putter heads for printing. The dummy blanks may be in the shape of separate quarter cylinder pieces or in a single ¾ cylinder or ½ cylinder piece. Thus, four putter heads may be printed simultaneously or fewer than four, i.e. one, two, or three, may be printed.

Figure 4:
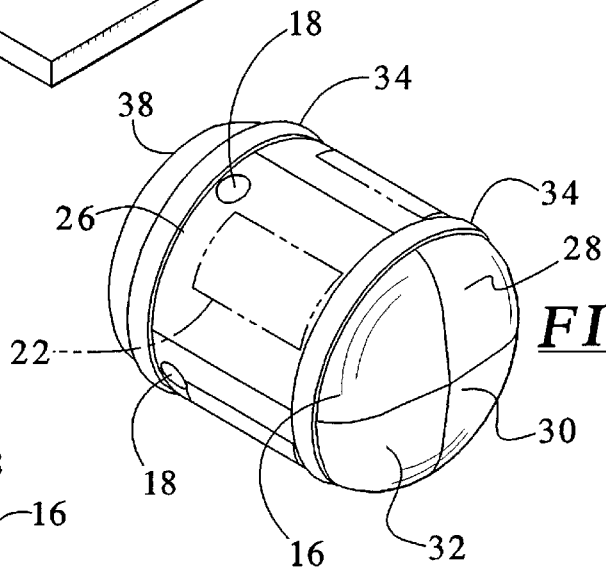
FIG. 4 is a perspective view of the four putter heads of FIG. 3 held together by the retaining bands to form a cylinder.

FIG. 4 illustrates the resulting shape of four blank putter heads assembled with the retaining bands 34. The diameter of the cylindrical body formed thereby approximately corresponds to the diameter of a mug, such as a coffee mug. For instance, a diameter of 2 ¾ to 3 ½ inches is common for coffee mugs. An imprintable region 22 is provided on the cylindrical outer surface 26 of the putter heads. The imprintable region 22 may extend over the entire cylindrical surface 26 or may be restricted to one portion thereof, as shown in FIG. 4.

At least the imprintable region 22 and possibly the entire surface of the putter head 16 is provided with a coating of imprintable material, such as polyester. A plastic coating may be used such as a polyester hybrid coating to receive sublimation ink or toner. As an alternative, a semi-porous coating or surface is provided to receive a wax transfer image.

The material of the putter head 16 of a preferred embodiment is a high density ceramic called alumina, which is coated with the polyester hybrid coating to receive the image. An alternative putter head is of a high density polyester to which tiny glass balls are added to add weight to the putter.

Figure 5:
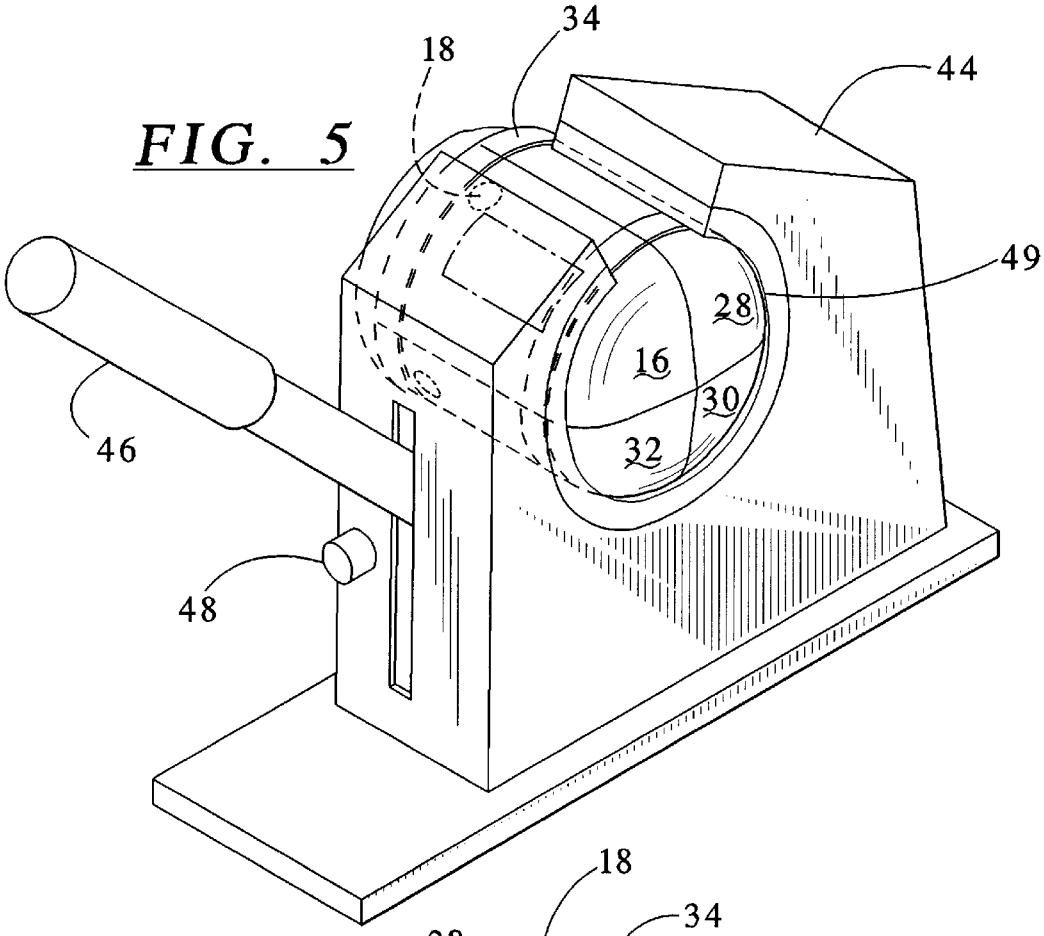
FIG. 5 is a perspective view of the four putter heads of FIG. 4 positioned for imprinting in a mug imprinting apparatus.

Referring now to FIG. 5, the assembled cylindrical body formed by the four blank putter heads 16, 28, 30 and 32 which are held in position by the retaining bands 34 is placed into the imprinting chamber of a mug imprinting apparatus 44. An imprint activating handle 46 and control switch 48 control the application of pressure and heat, respectively, to the cylindrical surface of the assembled putter heads 16, 28, 30 and 32 to imprint images thereon. The images are on a film or paper 49 positioned between the assembled cylindrical body and the imprinting chamber of the imprinting apparatus 44. The paper or film 49 may be held in place by heat resistant tape. Following imprinting, the assembled cylindrical body is removed from the imprinting apparatus, the retaining bands 34 removed therefrom and the four putter heads 16, 28, 30 and 32 separated from one another. Mounting of the club shaft 14 and grip 12 in the shaft hole 18 completes the assembly of four custom imprinted golf club putters.

The image to be imprinted on the blank putter heads is on a film or paper base 49 prior to transfer to the imprintable putter surface 22. The image may be generated by a computer printer, such as a color-ink jet printer, on wax transfer paper or by sublimation inks or toners. The computer may be used with image editing software to generate or modify any image for transfer to the putter head. Upon transfer, the inks or toners are transferred from the transfer paper or film 49 to the imprintable surface 22 of the putter 16. A putter body 16 with a polyester coating such as used on imprintable coffee mugs readily accepts the image as the ink goes into the coating and possibly into the glaze as well. White ceramic and glaze provides optimum image permanence, color density and contrast although other colors as possible. The sublimation printing in a polyester coating provides a permanent image which withstands high temperatures. Wax transfer to a porous imprintable surface is less permanent but is more readily used with existing ink jet printers and is cheaper.

Figure 6:
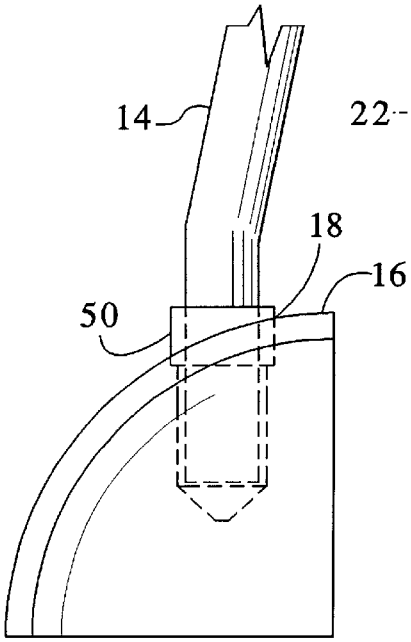
FIG. 6 is an end elevational view of the present putter head showing an alternate connection to the club shaft.

In FIG. 6, the mounting of the club shaft 14 is accomplished by a collar or sleeve 50 between the end of the club shaft 14 and the shaft mounting hole 18 in the putter head 16. The collar and sleeve 50 aid in mounting the head 16 on a club shaft 14.

It is contemplated to add inserts of varying materials to the present putter or to form the putter head of a material other than ceramic. The putter may be of metal and have a polymer coating on the quarter cylinder surface. However, in a preferred embodiment, the putter head is formed entirely of a ceramic material having a polymer coating similar to the polymer coating found on coated coffee mugs so that the imprint is permanently applied to the putter. A further embodiment of the present putter is cast with a bubble or other space in the body of the putter to provide a weight distribution for optimum putter performance.

Thus, there is shown and described a golf putter head which is custom imprintable using inexpensive and readily available equipment. The preferred putter head has a diameter of approximately 2½ to 4 inches, more commonly a range of 2¾ to 3¼ inches when four such putter heads are assembled into a cylindrical shape. It is contemplated to provide a holder as a three quarter cylinder-shape into which is single putter head is positioned for imprinting a single putter at one time. Other holder shapes are also contemplated.

Although other modifications and changes may be suggested by those skilled in the art, it is the intention of the inventor to embody within the patent warranted hereon all changes and modifications as reasonably and properly come within the scope of his contribution to the art.

I claim:

1. A golf putter head, comprising:

a putter head body having a ball striking surface and a lower surface generally at a right angle to the ball striking surface, said putter head body having a generally cylindrical portion surface centered on an axis formed by the intersecting planes of the ball striking surface and the lower surface to form a generally quarter cylinder shape for the putter head, said generally cylindrical portion surface including a substantially smooth imprintable surface area;

means defining an opening extending into the putter head body for mounting a club shaft; and an imprintable material coating on said substantially smooth imprintable surface area of said generally cylindrical portion surface, said imprintable material coating retaining indicia when printed.

2. A golf putter head as claimed in claim 1, wherein said putter head body is of ceramic and said imprintable surface is one of a polyester coating and a porous surface.

3. A set of imprintable golf putter heads, comprising:

four putter heads each in the shape of a quarter cylinder which, when assembled together, are capable of forming a cylindrical body, each of said putter heads having a surface forming a portion of the cylindrical body, said surface being provided with an imprintable material, each of said four putter heads having a ball striking surface.

4. A golf club putter head, comprising:

a quarter cylinder-shaped putter head body having a ball striking surface, a lower surface and a quarter cylinder outer surface portion having a smooth imprintable area, imprintable material coating provided on said smooth imprintable area of said quarter cylinder outer surface, indicia imprinted in said imprintable material coating, means defining an opening in said quarter cylinder outer surface for accepting a golf club shaft.

5. A golf club putter head as claimed in claim 4, wherein said putter body is provided with inserts of a material having a weight density different from a weight density of a material of said head body.

6. A golf putter head, comprising:

a putter head body having a ball striking surface and a lower surface generally at a right angle to the ball striking surface, said putter head body having a smooth cylindrical surface portion defined by rotating a radius about a center axis formed at an intersection of a plane of said ball striking surface and a plane of said lower surface, said smooth cylindrical surface being coated with an imprintable material; and a club shaft mount on said putter head body for mounting a club shaft.

7. A golf putter head, comprising:

a putter head body having a ball striking surface and a lower surface generally at a right angle to the ball striking surface, said putter head body having a generally cylindrical portion surface centered on an axis formed by the intersecting planes of the ball striking surface and the lower surface to form a generally quarter cylinder shape for the putter head, said generally cylindrical portion surface including a substantially smooth imprintable surface area;

means defining an opening extending into the putter head body for mounting a club shaft;

an imprintable material forming the putter head body and said substantially smooth imprintable surface area of said generally cylindrical portion surface, and indicia imprinted in said imprintable material at said substantially smooth imprintable surface area.

* * * * *